US009498967B2

(12) United States Patent
Leenen et al.

(10) Patent No.: US 9,498,967 B2
(45) Date of Patent: Nov. 22, 2016

(54) CARTRIDGE FOR HOLDING INK PELLETS

(71) Applicant: OCÉ-TECHNOLOGIES B.V., Venlo (NL)

(72) Inventors: Mark A. M. Leenen, Venlo (NL); Willemijn Elkhuizen, Venlo (NL); Kay Van 'T Hof, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/072,886

(22) Filed: Mar. 17, 2016

(65) Prior Publication Data

US 2016/0193844 A1 Jul. 7, 2016

Related U.S. Application Data

(63) Continuation of application No. PCT/EP2014/069844, filed on Sep. 17, 2014.

(30) Foreign Application Priority Data

Sep. 18, 2013 (EP) ..... 13184974

(51) Int. Cl.
*B41J 2/175* (2006.01)

(52) U.S. Cl.
CPC ..... *B41J 2/17513* (2013.01); *B41J 2/175* (2013.01); *B41J 2/17593* (2013.01); *B41J 2/17503* (2013.01)

(58) Field of Classification Search
None
See application file for complete search history.

(56) References Cited

U.S. PATENT DOCUMENTS

2011/0221837 A1 9/2011 Jones et al.
2012/0056959 A1* 3/2012 Smith ..... B41J 2/17593 347/88
2012/0287210 A1* 11/2012 Wayman ..... B41J 2/17593 347/99

FOREIGN PATENT DOCUMENTS

EP 0 178 882 A1 4/1986
EP 1 810 830 A1 7/2007
GB 2 237 773 A 5/1991
GB 2483340 A 3/2012

* cited by examiner

*Primary Examiner* — Lisa M Solomon
(74) *Attorney, Agent, or Firm* — Birch, Stewart, Kolasch & Birch, LLP

(57) ABSTRACT

A cartridge for holding ink pellets is provided. The cartridge comprises a first part and a second part. The first part comprises a first body, which first body comprises an exit adapted for releasing an ink pellet from the cartridge, and the first part comprising a separating unit, said separating unit being adapted for separating and releasing a single ink pellet and transporting said single ink pellet to said exit. The second part is configured for holding said ink pellets and comprises a second body being adapted for a sliding movement with respect to said first part in order to adjust a volume of the cartridge. The cartridge of the present invention improves transportation of said cartridge without reducing a capacity of the cartridge for holding a plurality of ink pellets.

12 Claims, 6 Drawing Sheets

CARTRIDGE FOR HOLDING INK PELLETS

CROSS REFERENCE TO RELATED APPLICATIONS

This application is a Continuation of PCT International Application No. PCT/EP2014/069844, filed on Sep. 17, 2014, which claims priority under 35 U.S.C. 119(a) to patent application Ser. No. 13/184,974.7, filed in Europe on Sep. 18, 2013, all of which are hereby expressly incorporated by reference into the present application.

FIELD OF THE INVENTION

The present invention relates to a cartridge for holding ink pellets. The present invention further relates to a cartridge kit, comprising the cartridge according to the present invention. The present invention further relates to an inkjet printer, comprising the cartridge according to the present invention.

BACKGROUND OF THE INVENTION

In a known printing system a cartridge for holding ink pellets is used. The cartridge is releasably mounted on an ink supply unit of the printing system for supplying ink pellets to a printing station of the printing system. The cartridge comprises an exit, a storage room for holding a plurality of ink pellets and a separating unit, said separating unit being adapted for separating and releasing a single ink pellet and feeding said single ink pellet to said exit. The storage room provides a capacity for holding a plurality of ink pellets, which plurality of ink pellets is suitably selected to be sufficient for a certain number of images or for a certain time of using the printing system. The cartridge, including the separating unit, is a durable component, which lasts longer than the time for using the ink pellets in the cartridge. In case the storage room is emptied, the cartridge may be taken from the supply unit and may be sent back to a supplier of the cartridge, which supplier may refill the cartridge with ink pellets. The refilled cartridge may be delivered to a customer for a second use cycle of the refilled cartridge.

A need exists for a cartridge for holding ink pellets, which cartridge improves transportation of said cartridge without reducing a capacity of the cartridge for holding a plurality of ink pellets.

SUMMARY OF THE INVENTION

It is accordingly an object of the present invention to provide a cartridge for holding ink pellets, which cartridge improves transportation of said cartridge without reducing a capacity of the cartridge for holding a plurality of ink pellets.

This object is attained by a cartridge for holding ink pellets, said cartridge comprising:

- a first part comprising a first body, which first body comprises an exit adapted for releasing an ink pellet from the cartridge, and the first part comprising a separating unit, said separating unit being adapted for separating and releasing a single ink pellet and transporting said single ink pellet to said exit; and
- a second part for holding said ink pellets; said second part comprising a second body being adapted for a sliding movement with respect to said first part in order to adjust a volume of the cartridge.

The first body may be a frame, may be a casing and may be a body structure adapted for supporting the separating unit. The first body may enclose the separating unit.

The second body may be a frame, may be a casing and may be a body structure adapted for supporting a plurality of ink pellets. The second body may enclose the plurality of ink pellets.

Each of the first body and the second body may have a rectangular shape. Each of the first body and the second body may comprise a base surface adapted for supporting an ink pellet and may additionally comprise three side surfaces, each of the three side surfaces extending in a direction, which is substantially perpendicular to the base surface. Each of the first body and the second body may comprise a top surface, which is arranged at an end of the respective first body and second body opposite with respect to the base surface of the respective first body and second body. Each of the first body and the second body may comprise three side surfaces, wherein two of the three side surfaces are arranged substantially parallel to each other.

The exit may be arranged on any of the base surface, side surfaces and top surface of the first body. The exit may have any shape suitable for releasing an ink pellet from the cartridge.

The first part comprises a separating unit. The separating unit may be adapted for separating and releasing a single ink pellet at a time and transporting said single ink pellet to said exit. The separating unit may be connected to the first body. The separating unit may be enclosed by the first body. The separating unit may comprise a rotatable shaft extending in a transport direction comprising a spiraling member at the circumference of said shaft. The separating unit may be arranged for transporting an ink pellet in the transport direction towards the exit of the first body. The separating unit may be adapted for transporting a plurality of sequentially separated single ink pellets to said exit at a time. The separating unit may extend between a base surface of the first body and said exit.

The ink pellet used may comprise a hot melt ink. An ink of this kind is solid at room temperature and liquid at elevated temperatures. This ink may be dispensed in solid form in a print head of a printing system where after the ink in the print head is melted and brought to operating temperature, typically 130° C.

The second body is adapted for a sliding movement with respect to the first part. In particular the second body may be adapted for a sliding movement with respect to the first body. As used herein a sliding movement is a movement of being slid along a surface.

The second body may comprise a surface which is adapted for a sliding movement along an outer surface of the first body, wherein an outer surface faces outwards of the first body. The second body may comprise a surface which is adapted for a sliding movement along an inner surface of the first body, wherein an inner surface faces inwards of the first body.

The second body is adapted for a sliding movement in order to adjust a volume of the cartridge. The second body may be adapted for adjustably nesting the second body inside the first part, thereby adjusting a volume of the cartridge. The second body may be adapted for adjustably nesting the first body inside the second body, thereby adjusting a volume of the cartridge.

The cartridge of the present invention has the advantage that a volume of the cartridge may be adjusted according to the need for providing a certain volume for storing ink pellets. For example during transportation of the cartridge it is preferable to slidably retract the cartridge and thereby decrease the volume. During use of the cartridge in an inkjet printing system it may be preferable to slidably extend the cartridge and thereby increase the volume in order to provide a sufficient storage space for holding ink pellets. In an example the cartridge may be used in several inkjet printing systems, wherein the cartridge may be adjusted for having dissimilar volumes with respect to each other depending on the ink demands of the specific inkjet printing system. For example in an inkjet printing system for display graphics, applications, the demand for ink is relatively high and the volume of the cartridge may be accordingly adjusted to be relatively large. In another example in an inkjet printing system for a low volume printing application, the demand for ink is relatively low and the volume of the cartridge may be accordingly adjusted to be relatively low. Accordingly said inkjet printing system for a low volume printing application may have an ink supply unit, which ink supply unit is adapted for receiving the cartridge and is adapted for having a compact size based on the adjusted volume of the cartridge.

In an embodiment the second body may be adapted for a sliding movement in a substantially linear movement with respect to first body. This embodiment supports a relatively simple construction of the second body and the first body.

In another embodiment the second body may be connected to the first body at a first connection, wherein the second body is rotatably movably arranged with respect to the first connection while being adapted for a sliding movement with respect to the first body away from the first connection. In an example the first connection may be an axis extending in an axial direction and the second body may be rotatable around the axis, while being adapted for a sliding movement with respect to the first body away from the axis. This embodiment supports a reliable connection between the second body and the first body.

In an embodiment of the cartridge, the second body comprises a plurality of slidable body surfaces, wherein each of the plurality of slidable body surfaces is slidably movable with respect to a surface of the first body. This embodiment supports a sliding movement of the second body with respect to the first body.

In an embodiment of the cartridge, said plurality of slidable body surfaces comprises a base surface and two side surfaces, each of said two side surfaces being arranged at a lateral end of the second body and opposite with respect to each other. For example the second body may have a rectangular shape.

In an embodiment of the cartridge, each of said plurality of slidable body surfaces is arranged substantially parallel to said corresponding surface of the first body. This embodiment supports a sliding movement of the second body with respect to the first body.

In an embodiment of the cartridge, the second body comprises a fill entrance adapted for filling ink pellets into the second part. The fill entrance may be a refill entrance used for refilling the cartridge. The fill entrance may also be used for a first time filling of the cartridge by ink pellets at the customer. The advantage is that the cartridge may be transported to the customer in a retracted state, wherein the cartridge has a low volume. The fill entrance may be adapted for both filling ink pellets into the first part and the second part of the cartridge.

In an embodiment of the cartridge, said fill entrance comprises a cover, which is adapted for a sliding movement in order to open or close the fill entrance. The cover may be adapted for automatically closing the fill entrance. For example the cover may be spring loaded such that the cover automatically closes the fill entrance. The cover in a closed position prevents contaminations from entering the cartridge.

In an embodiment of the cartridge, said cover is adapted for a sliding movement with respect to a surface of the first body. The sliding movement of the cover supports a compact and simple mechanism for opening the fill entrance.

In an embodiment of the cartridge, said separating unit comprises:

- a rotatable shaft extending in a transport direction comprising a spiraling member at the circumference of said shaft; and
- a tangential movement confining member extending in a parallel direction with respect to said rotatable shaft, positioned at a distance from said spiraling member for confining the tangential movement of an ink pellet, engaging with said spiraling member to form a stable position for transporting said ink pellet in said transport direction.

Said spiraling member may be adapted for transporting the ink pellet in the transport direction. The tangential movement confining member may be positioned at a distance from said spiraling member for confining the tangential movement of an ink pellet away from said rotatable shaft. Said stable position may be a stable area for transporting said ink pellet in said transport direction.

In an embodiment of the cartridge, the rotatable shaft is positioned at an angle with respect to the direction of the gravitation force, such that on each winding two areas can be distinguished;

- a first, stable area on which an ink pellet tends to roll towards the tangential movement confining member; and
- a second, instable area on which an ink pellet tends to roll away from the tangential movement confining member and off the spiraling member.

In an embodiment of the cartridge, the tangential movement confining member is positioned with respect to the spiraling member, such that only one single position for the transportation of an ink pellet is formed in said first stable area on each winding of the spiraling member.

In an embodiment of the cartridge, the angle of the rotatable shaft with respect to the direction of the gravitation force in operatively connected state, is larger than or equal to the pitch angle of the spiraling member with respect to the plane extending perpendicular to the direction of the rotatable shaft.

In another aspect of the present invention a cartridge kit is provided, comprising the cartridge according to the present invention and a fill container for holding ink pellets, said fill container comprising a plurality of ink pellets and being adapted for mounting to the cartridge. The fill container may be a refill container adapted for refilling the cartridge. The fill container may also be used for a first time filling of the cartridge by ink pellets at the customer. The advantage is that the cartridge may be transported to the customer in a retracted state, wherein the cartridge has a reduced volume. The fill container is adapted for mounting to the cartridge in order to fill the cartridge.

The fill container may further comprise a Near Field Communication (NFC) chip configured for wireless communicating information to a near field communication scanner. The NFC chip may comprise information regarding at least one of the type of ink pellets, relevant properties of the ink pellets (for example ink color and/or ink viscosity) and the amount of ink pellets stored in the fill container. An inkjet printing system may have a Near Field Communication scanner adapted for receiving the information from the NFC chip of the fill container. The inkjet printing system may be adapted for receiving the information from the NFC chip during filling of the cartridge by the fill container.

In an embodiment of the cartridge kit, said fill container comprises a release exit adapted for filling said cartridge with said ink pellets, wherein said release exit is arranged for communication to the fill entrance of the cartridge whereby the fill container is mounted to the cartridge. A position of the release exit in the fill container is adapted to a position of the fill entrance of the cartridge. In a mounting assembly of the fill container to the cartridge the release exit is arranged in communication to the fill entrance in order that the ink pellets inside the fill container may easily moved into the cartridge.

In another aspect of the present invention an inkjet printer is provided, said inkjet printer comprising an ink supply unit and the cartridge of the present invention, wherein said cartridge is releasably connectable to the ink supply unit.

In an embodiment of the inkjet printer, the inkjet printer comprises driving means, which are operatively connected to the separating unit, wherein the driving means are adapted for driving said separating and releasing the single ink pellet and feeding said single ink pellet to said exit of the cartridge.

Therefore the present invention pertains to a cartridge to accommodate a plurality of ink pellets, said cartridge comprising:

an exit to release an ink pellet from said cartridge; and a separating unit adapted for separating a single ink pellet from said plurality of ink pellets and transporting said single ink pellet to said exit;

wherein the cartridge has two parts that are telescopically movable relative to one another between an extended state and a retracted state of the cartridge.

As defined herein the two parts of said cartridge are moveably arranged between an extended state and a retracted state of the cartridge by a sliding movement, wherein a volume of the cartridge to accommodate the plurality of ink pellets is adjustable. The cartridge in a retracted state requires only little space during transport and storage. The cartridge may be arranged in the extended state to provide a sufficient storage space for holding ink pellets, for example during use of the cartridge in an inkjet printer.

In an embodiment of the cartridge, a first part of the cartridge comprises a sliding surface, and a second part of the cartridge comprises a sliding surface held in sliding engagement with the sliding surface of the first part. As defined herein each part may comprise a body and each sliding surface may be a slidable body surface of a respective body.

In an embodiment of the cartridge, the sliding surface of the second part is conformed at least in part to the shape of said sliding surface of the first part. This enables a sliding engagement of the sliding surfaces relative to one another.

In an embodiment of the cartridge, the first part comprises a first end surface and the second part comprises a second end surface disposed at an opposite lateral end of the cartridge with respect to the first end surface and wherein said exit is arranged within said first end surface and the separating unit is connected to said first part.

As defined herein a first end surface of the first part and the second end surface of the second part are arranged opposite with respect to each other and are moved apart in a movement of the two parts towards the extended state of the cartridge.

As a result an ink pellet may be released from the exit both in the extended state as well as in the retracted state of the cartridge. In the retracted state the exit is not blocked by any sliding surfaces of the second part.

In an embodiment of the cartridge, said second part of the cartridge comprises a fill entrance adapted for filling ink pellets into the cartridge. The advantage is that the cartridge may be transported to the customer in a retracted state, wherein the cartridge has a low volume. The fill entrance may be adapted for both filling ink pellets into the first part and the second part of the cartridge.

In an embodiment of the cartridge, said fill entrance comprises a cover, which cover is movably attached to the second part for a sliding movement along said fill entrance to open or close the fill entrance. The advantage is that the cartridge may be filled by ink pellets supplied from a fill container without contaminations entering the cartridge.

In an embodiment of the cartridge, said cover is held in sliding engagement with respect to a sliding surface of the first part. This enables arrangement of the fill entrance in the second part close to the first part.

In an embodiment of the cartridge, wherein said separating unit comprises:

a rotatable shaft extending in a transport direction and comprising a spiraling member at the circumference of said shaft arranged for transporting said ink pellet in the transport direction along said rotatable shaft to said exit; and a tangential movement confining member extending in the transport direction thereby facing said rotatable shaft, positioned at a distance from said spiraling member for confining the tangential movement of an ink pellet with respect to the spiraling member, thereby forming with said spiraling member a stable transport location for said ink pellet on said spiraling member for transporting said ink pellet in said transport direction.

In another aspect of the invention a cartridge kit is provided, comprising the cartridge according to the invention and a fill container for holding ink pellets, said fill container comprising a plurality of ink pellets and being adapted for mounting to the cartridge to supply the plurality of ink pellets into the cartridge. The advantage is that the cartridge may be transported to the customer in a retracted state, wherein the cartridge has a reduced volume. The fill container is adapted for mounting to the cartridge in order to fill the cartridge.

In an embodiment of the cartridge kit, said fill container comprises a release exit arranged for filling said cartridge with said ink pellets. In a mounting assembly of the fill container to the cartridge the release exit is arranged in communication to the fill entrance in order that the ink pellets inside the fill container may easily moved into the cartridge.

In another aspect of the invention an inkjet printer is provided comprising an ink supply unit and the cartridge according to the present invention, wherein said cartridge is releasably connectable to the ink supply unit.

In an embodiment of the inkjet printer, the inkjet printer comprises driving means, which are operatively connected to the separating unit, wherein the driving means is adapted for driving said separating unit for separating the single ink pellet and transporting said single ink pellet to said exit of the cartridge.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

Hereinafter, the present invention is further elucidated with reference to the appended drawings showing non-limiting embodiments and wherein.

DETAILED DESCRIPTION OF EMBODIMENTS

Figure 1A:
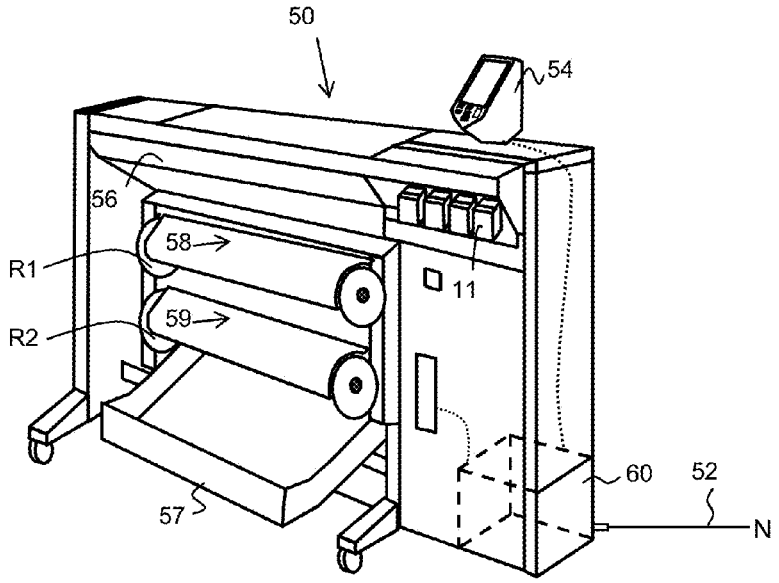
FIG. 1A shows an image forming apparatus, wherein printing is achieved using a wide format inkjet printer.

The present invention will now be described with reference to the accompanying drawings, wherein the same reference numerals have been used to identify the same or similar elements throughout the several views.

Figure 1B:
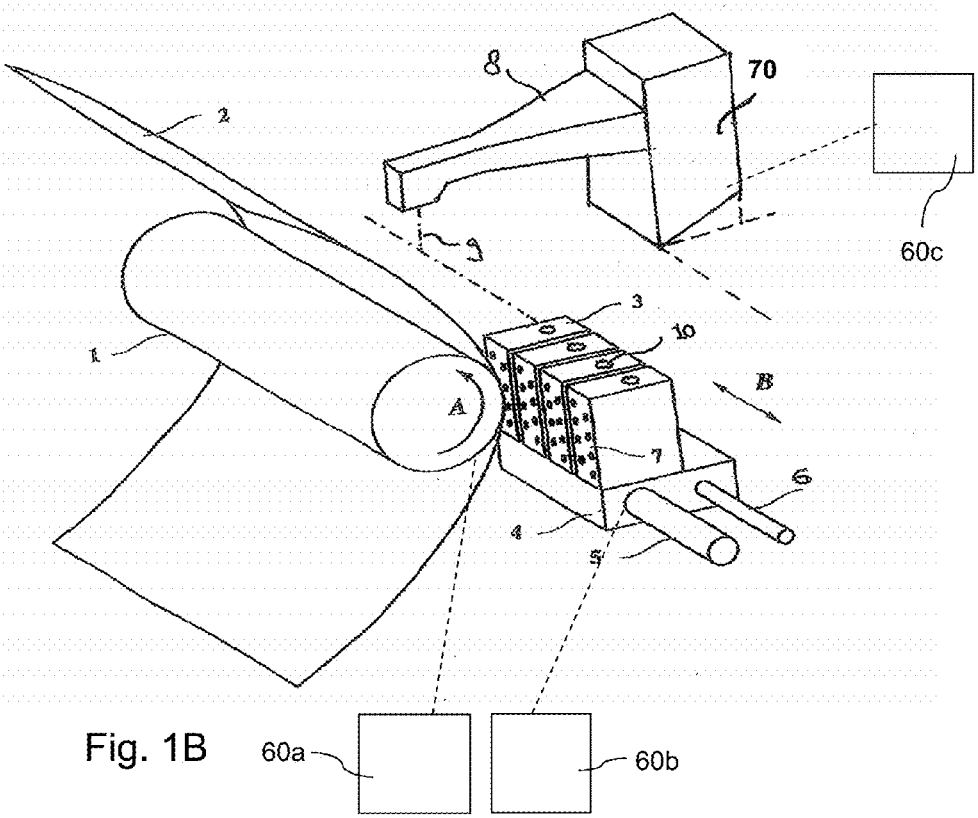
FIG. 1B shows the operative connection of the cartridge to the respective print heads.

FIG. 1A shows an image forming apparatus 50, wherein printing is achieved using a wide format inkjet printer. The wide-format image forming apparatus 50 comprises a housing 56, wherein the printing assembly, for example the ink jet printing assembly shown in FIG. 1B is placed. The image forming apparatus 50 also comprises an input station for storing print substrate 58, 59, an output station to collect the print substrate 58, 59 after printing and a cartridge for marking material 70. In FIG. 1A, the output station is embodied as a delivery tray 57. Optionally, the output station may comprise processing means for processing the print substrate 58, 59 after printing, e.g. a roll-up unit, a folder or a puncher. The wide-format image forming apparatus 50 furthermore comprises means for receiving print jobs and optionally means for manipulating print jobs. These means may include a user interface unit 54 and/or a control unit 60, for example a computer.

Images are printed on a print substrate, for example paper, supplied by a roll 58, 59. The roll 58 is supported on the roll support R1, while the roll 59 is supported on the roll support R2. Alternatively, cut sheet print substrates may be used instead of rolls 58, 59 of print substrate. Printed sheets of the print substrate, cut off from the roll 58, 59, are deposited in the delivery tray 57.

Each one of the marking materials for use in the printing assembly are stored in four cartridges 70 arranged for operatively connection with the respective print heads for supplying marking material to said print heads.

The local user interface unit 54 is integrated to the print engine and may comprise a display unit and a control panel. Alternatively, the control panel may be integrated in the display unit, for example in the form of a touch-screen control panel. The local user interface unit 54 is connected to a control unit 60 placed inside the printing apparatus 50. The control unit 60, for example a computer, comprises a processor adapted to issue commands to the print engine, for example for controlling the print process. The image forming apparatus 50 may optionally be connected to a network N. The connection to the network N is diagrammatically shown in the form of a cable 52, but nevertheless, the connection could be wireless. The image forming apparatus 50 may receive printing jobs via the network. Further, optionally, the controller of the printer may be provided with a USB port, so printing jobs may be sent to the printer via this USB port.

FIG. 1B shows the operative connection of the cartridge to the respective print heads. The image forming apparatus 50 comprises a roller 1 to support a substrate 2 and move it along the four print heads 3. The roller 1 is rotatable about its axis as indicated by arrow A. A carriage 4 carries print heads 3 and can be moved in reciprocation in the direction indicated by the double arrow B, parallel to roller 1. In this way print heads 3 can scan the receiving substrate 2, for example a sheet of paper. The carriage 4 is guided over rods 5 and 6 and is driven by means suitable for the purpose (not shown). In the example as illustrated in the drawing, each print head 3 contains eight ink ducts, each with its own nozzle 7, which form two rows of four nozzles each perpendicular to the axis of the roller 1. In a practical example of a image forming apparatus 50, the number of ink ducts per print head 3 will be many times greater. Each ink duct is provided with means for energising the ink duct (not shown) and an associated electric actuation circuit (not shown). In this way, the ink duct, the said means for energising the ink duct, and the actuation circuit form a unit which can serve to eject ink drops in the direction of roller 1. If the ink ducts are energised image-wise, an image forms which is build up from ink drops on the substrate 2.

When a substrate 2 is printed with an image forming apparatus 50 of this kind in which ink drops are ejected from ink ducts, the substrate 2, or part thereof, is (imaginarily) divided into fixed locations which form a regular field of pixel rows and pixel columns. In one example, the pixel rows are perpendicular to the pixel columns. The resulting separate locations can each be provided with one or more ink drops. The number of locations per unit of length in the directions parallel to the pixel rows and pixel columns is termed the resolution of the printed image, and is indicated, for example, as 400×600 d.p.i. ("dots per inch"). By image-wise energisation of a row of nozzles of the print head 3 of the image forming apparatus 50 when it moves over a strip of the substrate 2 in a direction substantially parallel to the pixel rows, the row of nozzles being substantially parallel to the pixel columns, as shown in FIG. 1, an image built up from ink drops forms on the substrate 2.

In this example, the image forming apparatus 50 is provided with a number of dispensing devices 8, one for each colour, only one being shown in FIG. 1 for simplification. With a dispensing device of this kind it is possible to dispense ink pellets at each of the print heads 3. The ink used is a hot melt ink. An ink of this kind is solid at room temperature and liquid at elevated temperatures. This ink is dispensed in solid form in each of the print heads 3 where after the ink in the print head 3 is melted and brought to operating temperature, typically 130° C. As soon as there is a likelihood of a shortage of liquid ink in one of the print heads 3, the carriage 4 will be so moved that the relevant print head 3 is disposed beneath the corresponding dispensing device 8 level with dispensing line 9. One or more ink pellets will then be dispensed to the print head 3, said pellets entering the print head 3 via opening 10. These pellets are then melted and brought to operating temperature. In this way each print head 3 can be provided with sufficient ink at all times.

The dispensing device 8 is fed with ink pellets by a cartridge 70 containing said ink pellets. Single ink pellets are released to the dispensing device 8 by means of release means in the cartridge 70. The dispensing device 8 can be an integrated part of the carriage or an integrated part of the image forming apparatus 50.

The roller 1 is controlled by control unit 60*a* for transporting the substrate 2. The carriage 4 and the four print heads 3 are controlled by control unit 60*b* for applying an image on the substrate 2. The dispensing device 8 is controlled by control unit 60*c* for feeding the ink pellets towards the print heads 3.

Figure 1C:
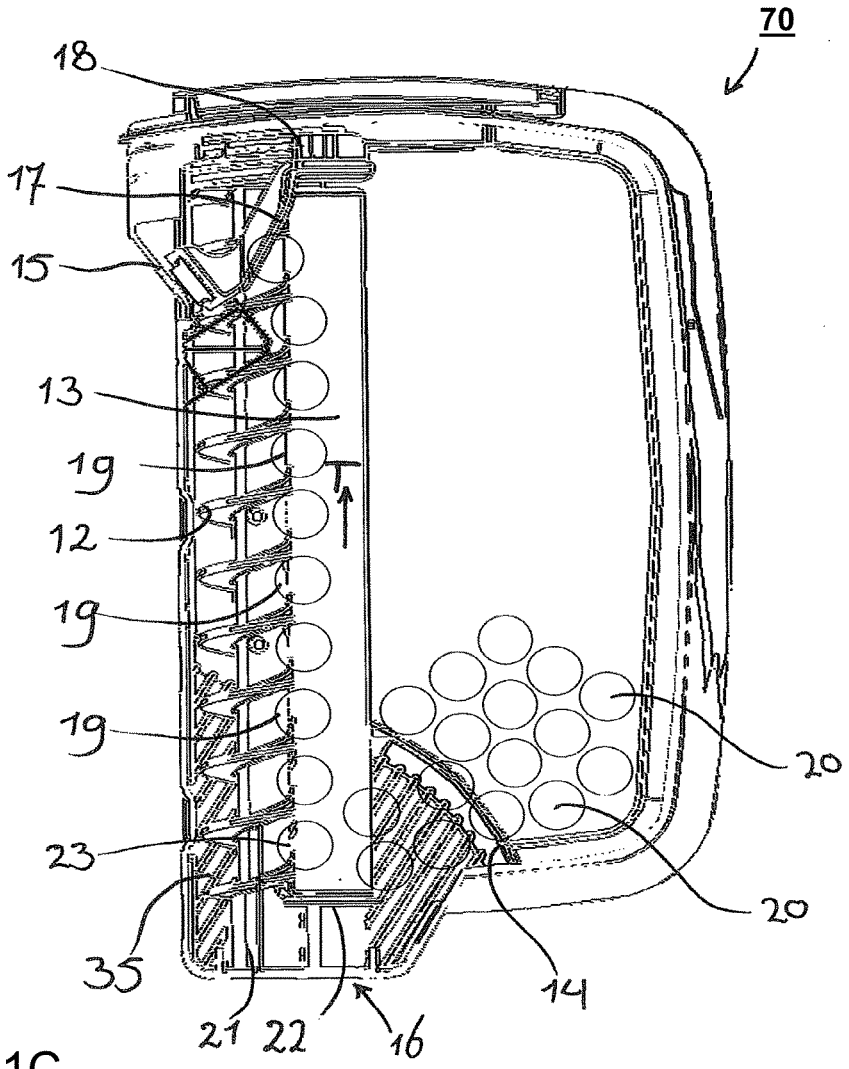
FIG. 1C shows a known cartridge.

FIG. 1C shows a known cartridge. The cartridge 70 holds a plurality of ink pellets 20. These ink pellets 20 are stored in an unorganised fashion. The cartridge 70 is suitable for manual installment on the inkjet printer 50 shown in FIG. 1A. Therefore an operator can install the cartridge 70 on the printer 50 by placing the contact surface 16 onto the destined surface of the printer 50. The printer 50 and the cartridge 70 comprise means for releasably connecting the cartridge 70 to the printer (not shown).

The cartridge 70 comprises a rotatable shaft comprising a spiraling member, in this example implemented as a cylindrical worm 12. When driven, the rotatable worm 12 transports pellets 20 in a transport direction (here from the bottom to the top of the cartridge) indicated by arrow T. The cartridge has an exit 15 where individual ink pellets are released to the dispensing device 8. The worm 12 engages with a tangential movement confining member 13 to form a single transport location 19 on each winding of the worm 12. In this example the movement confining member 13 is implemented as a rotatable cylinder. In another example (not shown) the movement confining member is implemented as a curved wall, of which the outside wall, at least partly faces the worm, confining the tangential movement of the pellets, which tend to roll towards the movement confining member. In another example (not shown) the movement confining member is implemented as a comb shaped member, of which the protrusive parts engage with the worm 12 confine the tangential movement of the pellets 20, forming transport locations 19 on each winding of the worm 12.

After each rotation of the worm 12, a single ink pellet 20 is released via the exit 15 to the dispensing device 8 resulting in a vacant transport location 23, which originates at the bottom of the worm 12. To overcome the problem of bridge forming pellets, which can obstruct the free entrance to the vacant transport location 23, a guide means 14 is positioned at the bottom of the cartridge 70. This guide means 14 prevents e.g. three pellets forming a bridge, resulting in an obstruction of the entrance to the vacant transportation location 23. This guide means 14 can e.g. be an integral part of the wall or walls, or can be a separate part positioned near bottom of the worm 12.

To be able to register the exit of a single ink pellet 20 at the exit 15, the cartridge 70 comprises a moveable detection member 17 positioned near the exit 15 of the cartridge 70. The moveable detection member 17 moves from its rest position to an elevated position under the influence of a passing ink pellet. This movement is detected by a magnetic sensor 18, which detects the change of a magnetic field under the influence of the moving detection member 17. The sensor 18 releases a signal on detection. This signal can be led e.g. to processing or storing means on the printer or to processing or storing means inside the cartridge itself. This signal can be used e.g. for the registration of a successful exit of an ink pellet 20, for the administration of the total number of ink pellets, to predict the up-to-date ink volume inside the print head or the like.

The space between the worm 12 and the tangential movement confining member 13 can be used to drain broken pellets. These broken pellets can disturb the ink administration and/or ink supply when supplied to the ink dispensing device 8. By the arrangement of the walls as e.g. shown in FIG. 1C an area 35 originates, in which broken ink pellets can be stored separated from the useable pellets 20.

In FIG. 1C the rotatable worm 12 and the rotatable tangential movement confining member 13 are operatively connectable to driving means (not shown) on the printer.

The rotatable worm 12 and the tangential movement confining member 13 comprise receiving means 21, 22 which are engageable to the external driving means. The rotatable means 12, 13 in the cartridge 70 are directly driven by the driving means. In another example the cartridge comprises only one receiving means to receive the driving means, and a gear drives both rotatable means 12, 13.

In another example of the known cartridge (not shown) the rotatable worm 12 and/or the tangential movement confining member 13 and an integral part of the inkjet printer and the cartridge 70 comprises receiving means for receiving the rotatable worm 12 and/or the tangential movement confining member 13.

Figure 2A:
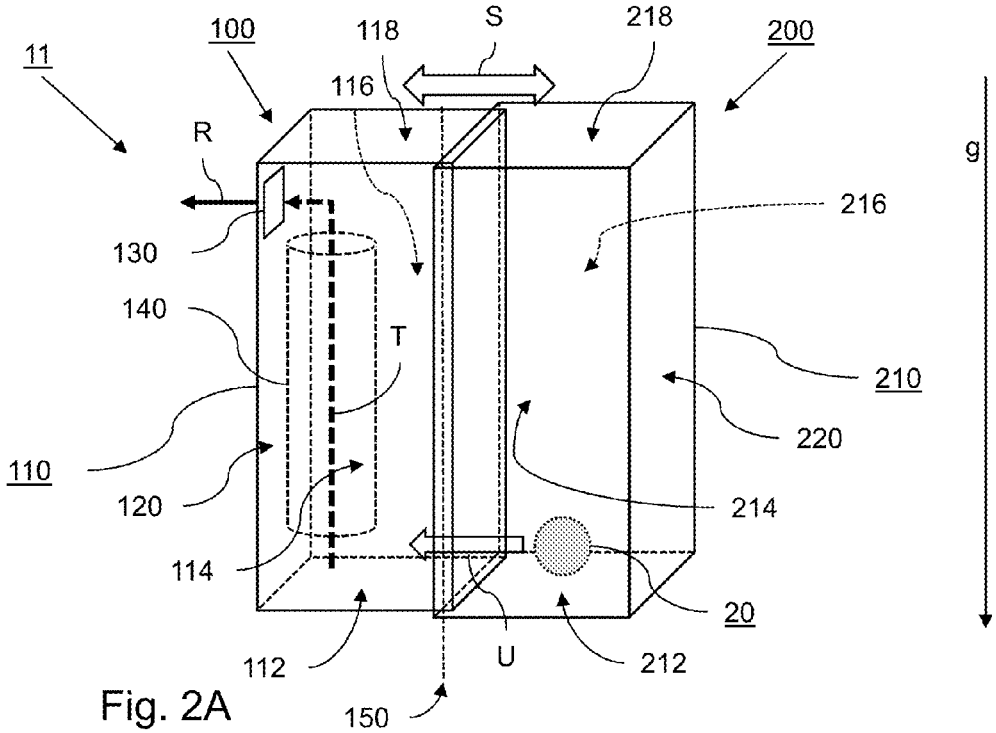
FIGS. 2A-2B shows a perspective side view of an embodiment of a cartridge according to the present invention.
Figure 2B:
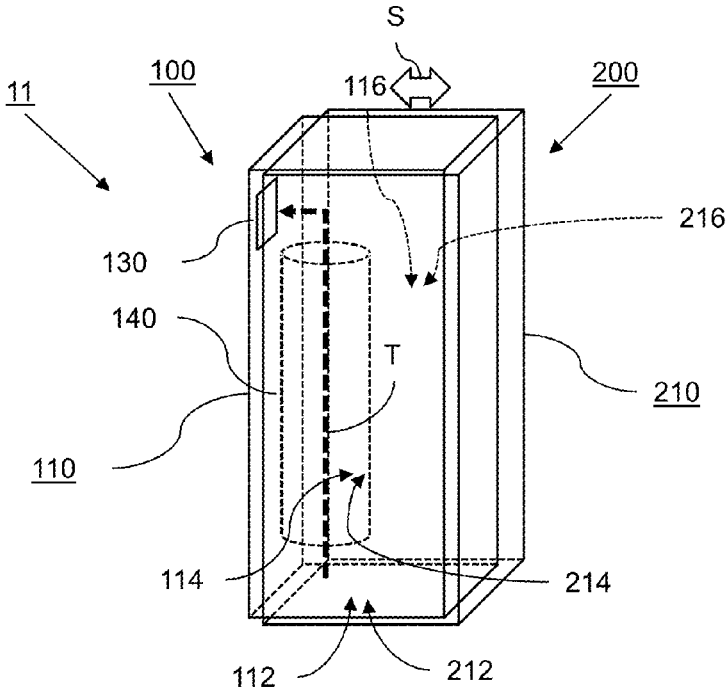

FIGS. 2A-2B shows a perspective side view of an embodiment of a cartridge according to the present invention. In FIG. 2A the cartridge 11 is in an extended state, wherein the volume of the cartridge 11 has been increased with reference to the retracted state as shown in FIG. 2B. The extended shape in FIG. 2A shows the ultimate extension of the cartridge 11.

In FIG. 2B the cartridge 11 is in a retracted state, wherein the volume of the cartridge 11 is reduced with reference to the extended state shown in FIG. 2A. The retracted state in FIG. 2B shows the ultimate compactness of the cartridge 11.

FIG. 2A shows the cartridge 11, which comprises a first part 100 and a second part 200. The first part 100 comprises a first body 110 and a separating unit 140. The separating unit 140 is connected to the first body 110 and enclosed by the first body 110. The first body 110 comprises an exit 130, a base surface 112, a top surface 118 and three side surfaces 114, 116, 120. In this embodiment the first body 110 has a substantially rectangular shape. The three side surfaces 114, 116, 120 comprise a first side surface 114, a second side surface 116 and a third side surface 120. The top surface 118 is arranged opposite to the base surface 112. The first side surface 114 is arranged at an opposite lateral end of the first body 110 with respect to the second side surface 116.

The separating unit 140 is adapted for separating and releasing a single ink pellet 20 from inside the cartridge 11 and transporting said single ink pellet to the exit 130 as indicated by arrow T. The exit 130 is arranged on the side surface 120 and provides an opening in the first body 110 for releasing an ink pellet from the cartridge 11 as indicated by arrow R.

The second part 200 comprises a second body 210. The second body 210 comprises a base surface 212, a top surface 218 and three side surfaces 214, 216, 220. The top surface 218 is arranged opposite to the base surface 212. The three side surfaces 214, 216, 220 comprise a first side surface 214, a second side surface 216 and a third side surface 220. The first side surface 214 is arranged at an opposite lateral end of the second body 210 with respect to the second side surface 216. The third side surface 220 of the second body 210 is arranged at an opposite lateral end of the cartridge 11 with respect to the third side surface 120 of the first body 110.

The second body 210 encloses a space adapted for storing a plurality of ink pellets 20. In this embodiment the second body 210 has a substantially rectangular shape. Any other shape and form of the second body 210 may be suitably selected for storing the plurality of ink pellets 20.

In operation of the cartridge 11 is arranged such that the base surfaces 112 and 212 are arranged at the lower end of the cartridge 11 with respect to a gravitation direction g.

The plurality of ink pellets 20 in the second part 200 is arranged in operative communication to the separating unit 140 in the first part 100.

The assembly of the first body 110 and the second body 210 provides a substantially closed cartridge 11 in order that any ink pellets 20 inside the cartridge 11 are stored inside and may not be lost. At an intersecting interface 150 between the first body 110 and the second body 210 the cartridge 11 comprises an opening adapted for guiding any ink pellet 20 inside the second body 210 towards the separating unit 140 in the first body 110 as indicated by arrow U.

The second body 210 is adapted for a sliding movement with respect to the first body 110 of the first part 100 in a direction as indicated by arrow S. In particular the base surface 212 is arranged substantially parallel to the base surface 112 of the first body 110 and is slidable with respect to the base surface 112. The first side surface 214 is arranged substantially parallel to the first side surface 114 of the first body 110 and is slidable with respect to the first side surface 114. The second side surface 216 is arranged substantially parallel to the second side surface 116 of the first body 110 and is slidable with respect to the second side surface 116. The top surface 218 is arranged substantially parallel to the top surface 118 of the first body 110 and is slidable with respect to the top surface 118.

In FIG. 2B the cartridge 11 of FIG. 2A is shown in a retracted state after a sliding movement of the second body 210 with respect to the first body 110. In the retracted state the first body 110 is substantially completely enclosed by the second body 219. During a sliding movement of the second body 210 with respect to the first body 110 the assembly of the first body 110 and the second body 210 remains a substantially closed cartridge 11 in order that any ink pellets 20 inside the cartridge 11 are kept inside and may not be lost.

The first body 110 and the second body 210 are adapted for limiting the sliding movement in the extended state shown in FIG. 2A. At the interface 150 shown in FIG. 2A both the first body 110 and the second body 210 comprises protruding elements, which are protruding from the respective first body 110 and second body 210, and are cooperatively arranged opposing each other at the interface 150 during a sliding movement direction S of the cartridge 100. Said protruding elements are arranged on a number of corresponding sliding surfaces 112, 212; 114, 214; 116, 216; 118, 218 of the first body 110 and the second body 210. The protruding elements are adapted for limiting the sliding movement during an extending movement of the cartridge 11 such that the first body 110 and second body 210 remain connected to each other in the extended state shown in FIG. 2A. It is generally known to a person skilled in the art to suitably select a shape, size and position of protruding elements for obstructing a sliding movement of one surface with respect to another surface.

Thus as shown in FIGS. 2A and 2B the two parts 100,200 of the cartridge 11 are telescopically movable relative to one another between said extended state (shown in FIG. 2A) and said retracted state of the cartridge 11 (shown in FIG. 2B). Furthermore as shown sliding surfaces 212, 214, 216, 218 of the second part 200 are held in sliding engagement with sliding surfaces 112, 114, 116, 118 of the first part 100. The third side surface (or first end surface) 120 of the first part 100 is arranged at the opposite lateral end of the cartridge with respect of the third side surface (or second end surface) 220 of the second part 200.

FIGS. 3A-3D show a perspective side view of an embodiment of a cartridge kit according to the present invention. The cartridge kit comprises a cartridge shown in FIGS. 3A and 3B and a fill container shown in FIG. 3C.

Figure 3A:
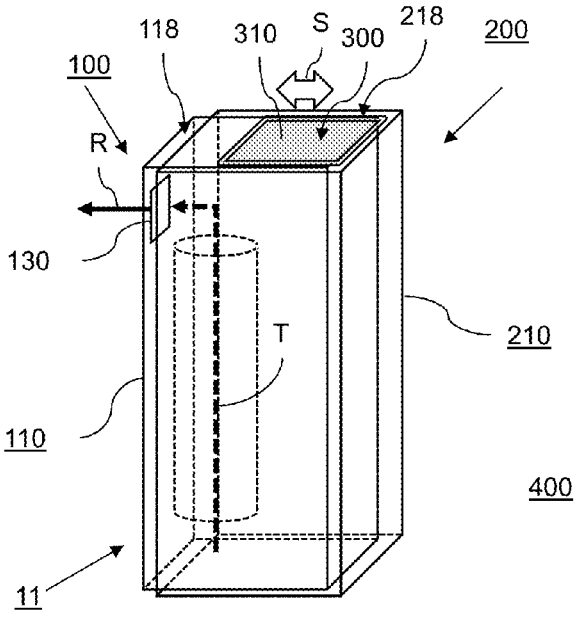
FIGS. 3A-3D show a perspective side view of an embodiment of a cartridge kit according to the present invention.
Figure 3C:
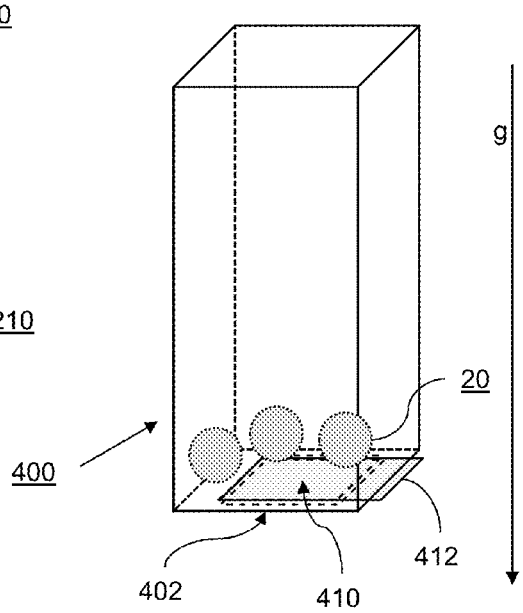
Figure 3B:
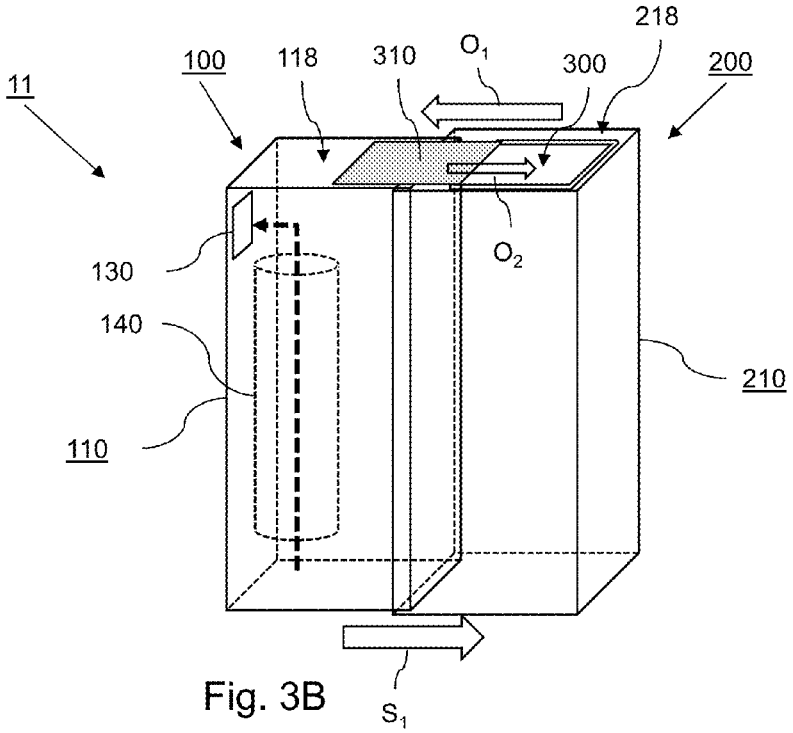

FIGS. 3A-3B shows an embodiment of a cartridge according to the present invention. The cartridge shown in FIGS. 3A-3B is similar in structure to the embodiment of the cartridge shown in FIGS. 2A-2B. Additionally the cartridge of the embodiment of FIG. 3A and FIG. 3B comprises a fill entrance 300. The fill entrance 300 is arranged on the top surface 218 of the second body 210. The fill entrance 300 is adapted providing an opening for filling and/or refilling ink pellets into the second part 200 of the cartridge 11. The fill entrance 300 is covered by a cover 310. The cover 310 is adapted for a sliding movement in a direction as indicated by arrow $O_1$ shown in FIG. 3B in order to open the fill entrance 300. As shown in FIG. 3B the cover 310 is slidably arranged with respect to both the top surface 218 and the top surface 118. In FIG. 3B the second body 210 has been moved in a direction $S_1$ with respect to the first body 110 in order to increase the volume of the cartridge 11 to a maximum volume of the extended state shown in FIG. 3B. The cover 310 is slidably moved in a direction $O_1$ in order to open the fill entrance 300. In this state any ink pellets 20 may be moved into the cartridge 11 via the fill entrance 300. The cover 310 may be moved backwards opposite to the direction $O_1$ in order to close the fill entrance 300. Alternatively the cover may be adapted for automatically closing the fill entrance in the direction $O_2$. For example the cover may be spring loaded in the direction $O_2$ such that the cover automatically closes the fill entrance. The cover in a closed position prevents contaminations from entering the cartridge.

FIG. 3C shows a fill container according to the present invention. The fill container 400 has a substantially rectangular shape and comprises a base surface 402, four side surfaces and a top surface. The fill container further comprises a release exit 410, which is covered by a slidable cover 412. The release exit 410 is arranged on the base surface 402. The fill container is filled with a plurality of ink pellets 20. In alternative embodiments the release exit 410 may be arranged on any other of the side surfaces or top surface of the fill container.

Figure 3D:
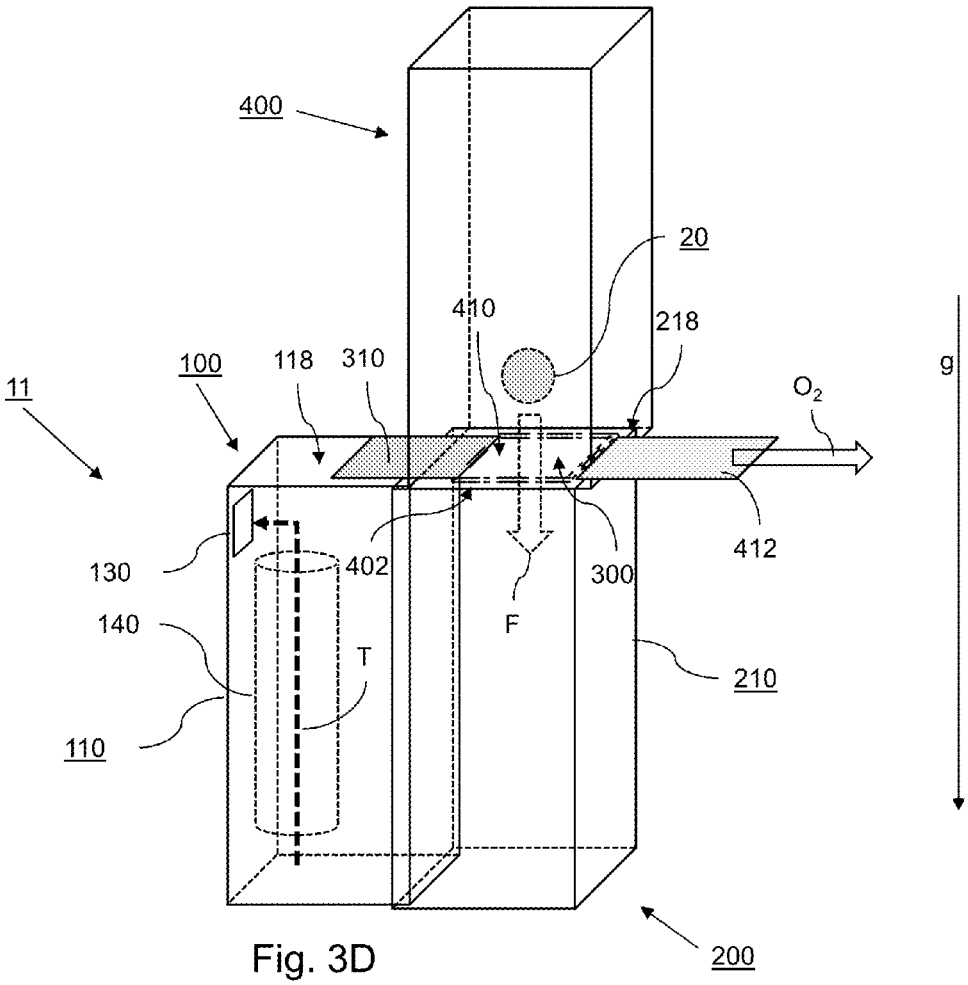

FIG. 3D shows an assembly of the cartridge of FIG. 3B and the fill container of FIG. 3C. The fill container 400 is mounted on the second body 210 of the cartridge 11. Thereby the release exit 410 is arranged in direct contact and communication to the fill entrance 300. The cover 310 is moved offset from the fill entrance 300, such that the fill entrance 300 is opened. The cover 412 of the release exit 410 is slidably moved with respect to the base surface 402 of the fill container 400 and the top surface 218 of the second body 210 in a direction as indicated by arrow $O_2$. As a result the ink pellets 20, which are retained in the fill container 400 may move downwards in a direction F into the second part 200 of the cartridge 11 due to a gravitational force acting in a direction g. After the cartridge 11 is filled or refilled by the ink pellets 20, the fill entrance 300 may be closed cover 310 and the fill container 400 may be separated from the cartridge 11.

The size of the fill container 400 and/or the number of ink pellets 20 contained in the fill container 400 may be suitably selected in order to fill the cartridge 11.

Figure 4A:
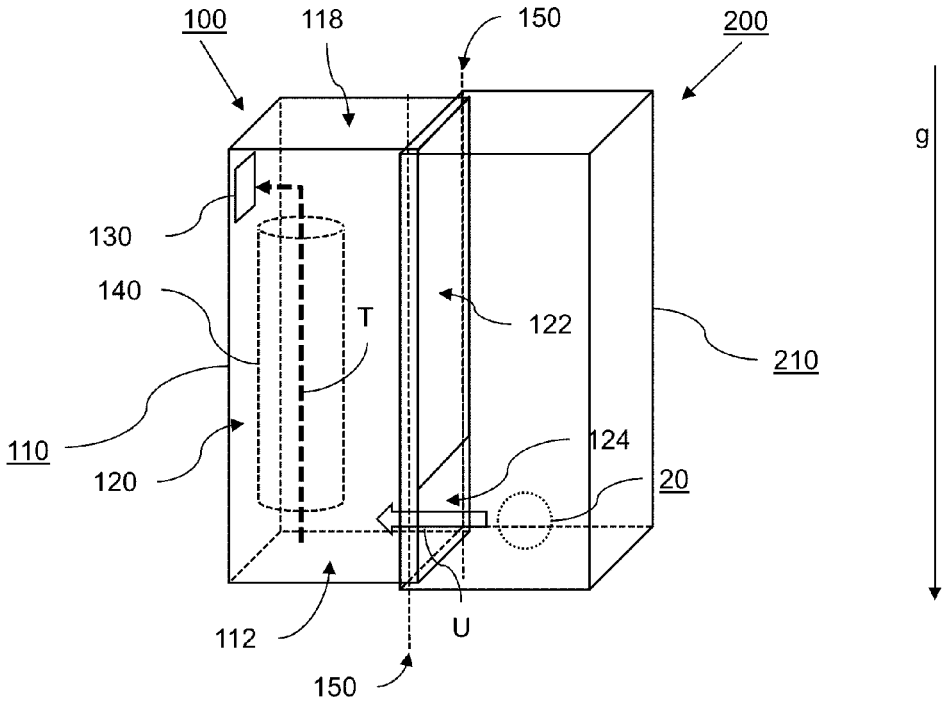
FIG. 4A shows an embodiment of the cartridge according to the present invention.

FIG. 4A shows an embodiment of the cartridge. In the embodiment the first body 110 may comprise a fourth side surface 122 which is arranged near the interface 150 at a lateral end of the first body 110 opposite to the third side surface 120. The fourth side surface partly closes the first body 110 at the interface 150 to the second body 210. An opening 124 is arranged at the interface 150 below the fourth side surface 122 in the gravitation direction g. The ink pellets 20 present in the second part 200 are moved towards the opening 124 by the gravitational force. This has the advantage that in case the second body 210 is filled up by a plurality of ink pellets 20, said ink pellets 20 are guided towards the separating unit 140 in the first body 110 as indicated by arrow U at the opening 124 between the first body 110 and the second body 210.

Figure 4B:
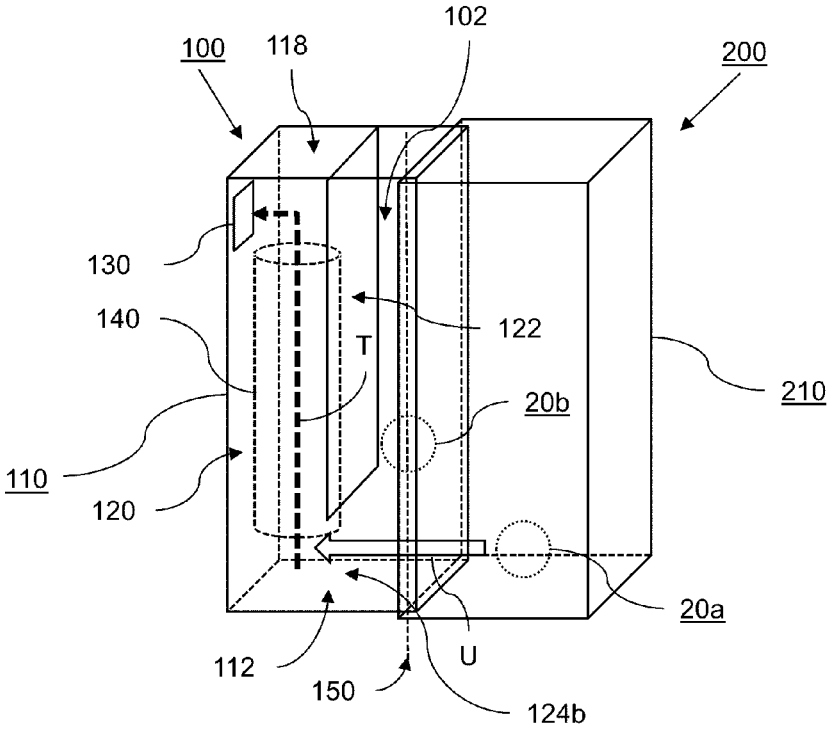
FIG. 4B shows an alternative embodiment of the cartridge according to the present invention.

FIG. 4B shows an alternative embodiment, wherein the first body 110 comprises a fourth surface 122 which is arranged inside the first body 110 adjacent to the separating unit 140 and extends parallel to the third side surface 120. The fourth surface 122 separates a storage portion of the first part 102 from another portion comprising the separating unit 140. The fourth surface 122 surface extends between the first side surface 114 and the second side surface 116. An opening 124 is arranged below the fourth side surface 122 in the gravitation direction g. The storage portion of the first part 102 extends between the fourth surface 122 and the interface 150 to the second part 200. Said portion of the first part 102 is arranged in open communication to the second body 210 and is adapted for in cooperatively with the second body 210 holding the plurality of ink pellets 20*a*, 20*b*. The ink pellets 20*a*, 20*b* are moved towards the opening 124*b* by a gravitational force. Both said ink pellets 20*a* inside the second part 200 and said ink pellets 20*b* inside the storage portion of the first part 102 are guided towards the separating unit 140 in the first body 110 as indicated by arrow U at the opening 124*b* inside the first part 100.

Detailed embodiments of the present invention are disclosed herein; however, it is to be understood that the disclosed embodiments are merely exemplary of the present invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the present invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A cartridge to accommodate a plurality of ink pellets, said cartridge comprising:

an exit to release an ink pellet from said cartridge; and a separating unit adapted for separating a single ink pellet from said plurality of ink pellets and transporting said single ink pellet to said exit;

wherein the cartridge has two parts that are telescopically movable relative to one another between an extended state and a retracted state of the cartridge.

2. The cartridge of claim 1, wherein a first part of the cartridge comprises a sliding surface, and a second part of the cartridge comprises a sliding surface held in sliding engagement with the sliding surface of the first part.

3. The cartridge of claim 2, wherein the sliding surface of the second part is conformed at least in part to the shape of said sliding surface of the first part.

4. The cartridge of claim 2, wherein the first part comprises a first end surface and the second part comprises a second end surface disposed at an opposite lateral end of the cartridge with respect to the first end surface and wherein said exit is arranged within said first end surface and the separating unit is connected to said first part.

5. The cartridge of claim 2, wherein said second part of the cartridge comprises a fill entrance adapted for filling ink pellets into the cartridge.

6. The cartridge of claim 5, wherein said fill entrance comprises a cover, which cover is movably attached to the second part for a sliding movement along said fill entrance to open or close the fill entrance.

7. The cartridge of claim 6, wherein said cover is held in sliding engagement with respect to a sliding surface of the first part.

8. The cartridge of claim 1, wherein said separating unit comprises:

a rotatable shaft extending in a transport direction and comprising a spiraling member at the circumference of said shaft arranged for transporting said ink pellet in the transport direction along said rotatable shaft to said exit; and a tangential movement confining member extending in the transport direction thereby facing said rotatable shaft, positioned at a distance from said spiraling member for confining the tangential movement of an ink pellet with respect to the spiraling member, thereby forming with said spiraling member a stable transport location for said ink pellet on said spiraling member for transporting said ink pellet in said transport direction.

9. A cartridge kit, comprising the cartridge according to claim 1 and a fill container for holding ink pellets, said fill container comprising a plurality of ink pellets and being adapted for mounting to the cartridge to supply the plurality of ink pellets into the cartridge.

10. The cartridge kit according to claim 9, wherein said fill container comprises a release exit arranged for filling said cartridge with said ink pellets.

11. An inkjet printer comprising an ink supply unit and the cartridge of claim 1, wherein said cartridge is releasably connectable to the ink supply unit.

12. The inkjet printer of claim 11, wherein the inkjet printer comprises driving means, which are operatively connected to the separating unit, wherein the driving means is adapted for driving said separating unit for separating the single ink pellet and transporting said single ink pellet to said exit of the cartridge.

* * * * *